US011592148B2

(12) United States Patent
Ernst

(10) Patent No.: US 11,592,148 B2
(45) Date of Patent: Feb. 28, 2023

(54) LUMINAIRE AND LUMINAIRE COMBINATION

(71) Applicant: ASTERA MANUFACTURING LIMITED, Guangdong (CN)

(72) Inventor: Norbert Ernst, Guangdong (CN)

(73) Assignee: ASTERA MANUFACTURING LIMITED, Shenzhen (CN)

( * ) Notice: Subject to any disclaimer, the term of this patent is extended or adjusted under 35 U.S.C. 154(b) by 0 days.

(21) Appl. No.: 17/395,206

(22) Filed: Aug. 5, 2021

(65) Prior Publication Data

US 2022/0356997 A1 Nov. 10, 2022

(30) Foreign Application Priority Data

May 8, 2021 (CN) ..... 2021209807863

(51) Int. Cl.
*F21S 2/00* (2016.01)
*F21V 21/005* (2006.01)

(52) U.S. Cl.
CPC ..... *F21S 2/005* (2013.01); *F21V 21/005* (2013.01)

(58) Field of Classification Search
CPC ..... F21S 2/005
See application file for complete search history.

(56) References Cited

U.S. PATENT DOCUMENTS 4,447,859 A * 5/1984 Raczynski ..... G03B 15/05 362/11
4,918,576 A * 4/1990 Farrall ..... G03B 15/05 362/11
7,963,669 B2 * 6/2011 Hockel ..... F21V 21/005 362/249.02
9,004,730 B2 4/2015 LaVigna et al.
10,995,941 B2 * 5/2021 Chami ..... F21S 2/00
11,085,594 B2 * 8/2021 Bufalini, Jr. ..... F21V 5/02
(Continued)

FOREIGN PATENT DOCUMENTS

CN 108518620 A 9/2018
KR 20090043215 A * 5/2019 ..... F21S 13/10
WO WO-2005015077 A1 * 2/2005 ..... F21S 2/005

OTHER PUBLICATIONS

Machine Translation of Neuhorst (WO2005/015077) (Year: 2005).*
(Continued)

*Primary Examiner* — Leah Simone Macchiarolo
(74) *Attorney, Agent, or Firm* — Hauptman Ham, LLP

(57) ABSTRACT

The disclosure provides a luminaire and a luminaire combination. The luminaire combination includes at least two luminaires. The luminaire includes a housing and a light source module received in the housing. The housing defines a connecting groove therein. The connecting groove is in a flat strip shape and extends from an outer surface of the housing. One end of the connecting groove is opened for insertion of a connector. The connecting groove is provided with a limit portion on each of two opposite side walls thereof. A gap between each limit portion and a bottom surface of the connecting groove forms a channel guide. The connector is provided with a connecting portion on each of two opposite sides thereof. The connecting portion is operable to be inserted into and matched with the channel guide corresponding to the connection portion.

20 Claims, 14 Drawing Sheets

(56) References Cited

U.S. PATENT DOCUMENTS

| | | | | |
|---|---|---|---|---|
| 2012/0163004 | A1* | 6/2012 | Hsia | F21V 21/30<br>362/418 |
| 2017/0370537 | A1* | 12/2017 | Wu | F21S 4/28 |
| 2018/0087755 | A1* | 3/2018 | Yorio | F21V 17/007 |

OTHER PUBLICATIONS

Machine Translation of Gill (KR20090043215) (Year: 2009).*
The Extended European Search Report issued in corresponding EP Application No. EP21189097.5, dated Jan. 20, 2022.

* cited by examiner

LUMINAIRE AND LUMINAIRE COMBINATION

CROSS-REFERENCE TO RELATED APPLICATION(S)

This disclosure claims priority to and the benefit of Chinese Patent Application Serial No. 202120980786.3, filed on May 8, 2021, the entire disclosure of which is hereby incorporated by reference.

TECHNICAL FIELD

The disclosure relates to the field of illumination devices, in particular to a luminaire and a luminaire combination.

BACKGROUND

In illumination for theaters, film and television production, and events, positioning and arrangement of luminaires are very important because illumination requirements of changeable sites and specific areas can be met only by positioning and arrangement of the luminaires. For existing luminaires, luminaire holders are generally mounted on supports or girders through brackets, and mounted with screws. Most of such products adopt a design of rotary mounting and use bolts as hinged bearings to adjust inclination of the luminaires. Most of such products use screw rods or handle screws which are used as brakes by loosening or tightening. Positioning brackets of the luminaires are almost all U-shaped or L-shaped. In order to mount the luminaires to the supports or the girders, the brackets of the luminaires generally adopt standard or customized threaded holes or through holes.

For the existing luminaires, flexibility in arrangement and alignment of the luminaires can sometimes be improved by adding a plurality of alternative screw holes on outer shells, and connecting screw holes are selected according to needs during mounting of the brackets. However, these screw holes require a certain minimum depth to ensure safety in connecting and mounting, thereby resulting in reduction of internal space of the luminaires and influences on available sizes of functional components (e.g., a transformer and a battery pack). Since the outer shells of the existing luminaires are generally die casting parts or extrusion parts, the portion of screw holes is required to extend to a bottom or two ends of each outer shell, so as to avoid undercuts. The existing luminaires are generally not provided with alternative mounting holes, so that the possibility of rotary aligning and compact mounting of the luminaires cannot be realized.

SUMMARY

In an aspect, a luminaire is provided. The luminaire includes a housing and a light source module received in the housing. The housing defines a connecting groove therein, where the connecting groove is in a flat strip shape and extends from an outer surface of the housing. The luminaire further includes a connector in a strip shape, where one end of the connecting groove is opened for insertion of the connector. The connecting groove is provided with a limit portion on each of two opposite side walls thereof, and a gap between each limit portion and a bottom surface of the connecting groove forms a channel guide. The connector is provided with a connecting portion on each of two opposite sides thereof. The connecting portion is operable to be inserted into and matched with the channel guide corresponding to the connection portion, such that the connecting portion is limited in the channel guide corresponding to the connecting portion via the limit portion corresponding to the connecting portion.

In an implementation, the housing is in columnar shape, a central axis of the housing coincides with a light outgoing direction of the light source module, and a length direction of the connecting groove is parallel to the central axis of the housing.

In an implementation, the housing is in a rectangular columnar shape, and defines one connecting groove on each of four side faces of the housing.

In an implementation, the connector defines a positioning screw hole therein. The positioning screw is operable to be in threaded connection with the positioning screw hole to allow an end portion of the positioning screw to be abutted against the bottom surface of the connecting groove, such that the connector is positioned in the connecting groove.

In an implementation, the connector defines a connecting screw hole in a middle positon along a length direction of the connector, and the connecting screw hole is located at a middle position between two connecting portions disposed on the two opposite sides of the connector.

In an implementation, the luminaire further includes a handwheel, the handwheel is provided with a handle screw at a position of a central axis of the handwheel, and the handle screw is operable to be in threaded connection with the connecting screw hole.

In an implementation, the connector is further provided with a fixing portion on each of the two opposite sides of the connector, and the fixing portion and the connecting portion cooperate to define a limit groove capable of accommodating the limit portion.

In an implementation, the two fixing portions extend away from each other and are in a flat and straight shape. The two fixing portions extend from one side surface, away from the connecting portion, of the connector to form a flat straight surface. Alternatively, the fixing portion and the connecting portion are of the same shape and size, the fixing portion is operable to be inserted into and matched with the channel guide, such that the connector serves as a connecting pin for connecting the housing the luminaire to a housing of another luminaire.

In another aspect, a luminaire combination is provided. The luminaire combination includes at least two luminaires described above.

In an implementation, the luminaire combination further includes at least one of a bracket, an adjusting plate, a hinge, and a cardan shaft.

The bracket is a bent plate in an L shape and has two arms which serve as a base plate in a square shape and a connecting plate in a triangular shape, respectively. The connector of the luminaire is disposed at the connecting plate. The connecting plate defines a connecting hole at a tip end, away from the base plate, of the connecting plate. A handle screw of a handwheel penetrates the connecting hole to be in threaded connection with the connecting screw hole of the connector.

The adjusting plate includes a first bearing plate in a rectangular shape, a second bearing plate, an adjusting handwheel, and a knurled screw. The first bearing plate and the second bearing plate are arranged in parallel. One connector of one luminaire is disposed at one short edge of the first bearing plate, the second bearing plate is arranged at the other short edge of the first bearing plate and another connector is disposed at the second bearing plate. The first bearing plate defines a rotating through hole at a long edge thereof, the second bearing plate defines a rotating screw hole at a position thereof corresponding to the rotating through hole, and the knurled screw penetrates the rotating through hole to be in threaded connection with the rotating screw hole, so as to form a hinge point between the first bearing plate and the second bearing plate. The first bearing plate defines a guide hole in an arc-strip shape, the second bearing plate defines an adjusting screw hole at a position of the second bearing plate corresponding to the guide hole, an adjusting screw rod is arranged at a position of a central axis of the adjusting handwheel, and the adjusting screw rod penetrates the guide holes to be in threaded connection with the adjusting screw hole.

The hinge includes a first hinge plate, a second hinge plate, and a hinge handwheel, the first hinge plate and the second hinge plate are hinged at their edges. One connector of one luminaire is disposed at the first hinge plate and one connector of another luminaire is disposed at the second hinge plate, and a length direction of each connector is parallel to a pivot between the first hinge plate and the second hinge plate. A brake plate is fixed on the first hinge plate, wherein the brake plate is perpendicular to the pivot between the first hinge plate and the second hinge plate and defines a hinge hole in an arc-strip shape, and a portion of the second hinge plate corresponding to the hinge hole is bent and defines a hinge screw hole therein. A hinge screw rod is arranged at a position of a central axis of the hinge handwheel, where the hinge screw rod penetrates the hinge hole to be in threaded connection with the hinge screw hole.

The cardan shaft includes a fixed end, two intermediate parts, and a free end sequentially rotationally connected. One wing handle screw is arranged between the fixed end and one intermediate part, one wing handle screw is arranged between the two intermediate parts, one wing handle screw is arranged between the other intermediate part and the free end, and the three wing handle screws provide three rotating shafts, and at least one of the three rotating shafts is perpendicular to the other two rotating shafts.

The luminaire and the luminaire combination are provided. Since the connecting groove is a flat shape arranged along the outer surface of the housing, its flat geometric structure occupies a small internal space of the luminaire, an internal reserved space of the luminaire is large and square, and thus a large component can be assembled in the housing. Through matching between the two connecting portions and the two limit portions, the two connecting portions are respectively limited in the two channel guides, so that firm and reliable connection is achieved between the connector and the housing. Mounting and demounting of the connector and the housing are facilitated by an inserting manner. The entire luminaire may be connected to other supports, girders, or the luminaire via the connector.

BRIEF DESCRIPTION OF THE DRAWINGS

In order to describe the technical solutions in the embodiments of the disclosure or the related art more clearly, the drawings required to be used in descriptions about the embodiments will be simply introduced below. The drawings in the following description are only drawings corresponding to part of the embodiments of the disclosure.

DETAILED DESCRIPTION

The technical solutions in the embodiments of the disclosure will be clearly and completely described below in combination with the drawings in the embodiments of the disclosure. It is apparent that the described preferred embodiments are not all embodiments but merely part of embodiments of the disclosure. On the basis of the embodiments of the disclosure, all other embodiments obtained on the premise of no creative work of those skilled in the art shall fall within the scope of protection of the disclosure.

Figure 1:
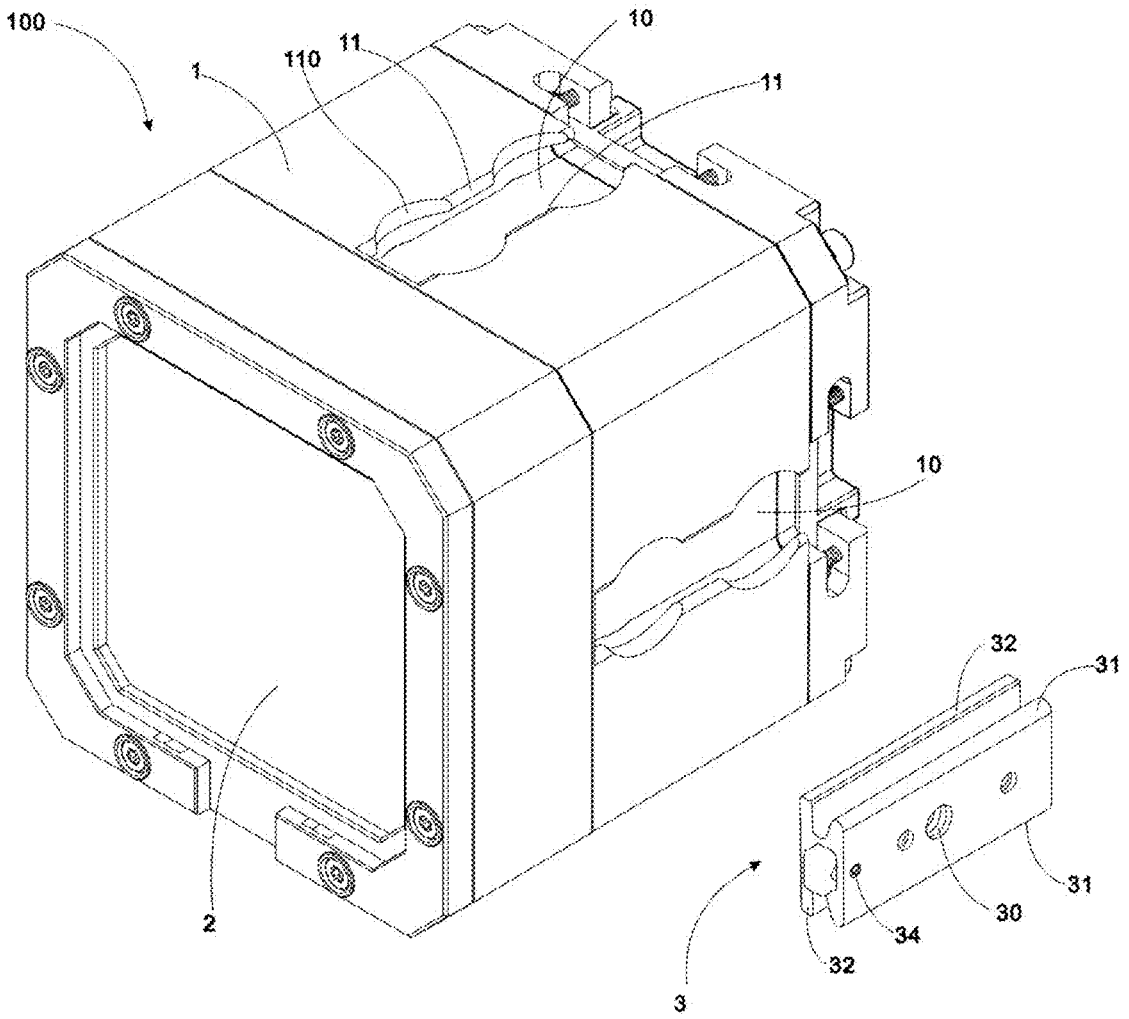
FIG. 1 is a three-dimensional structure schematic diagram of a luminaire of the disclosure.
Figure 2:
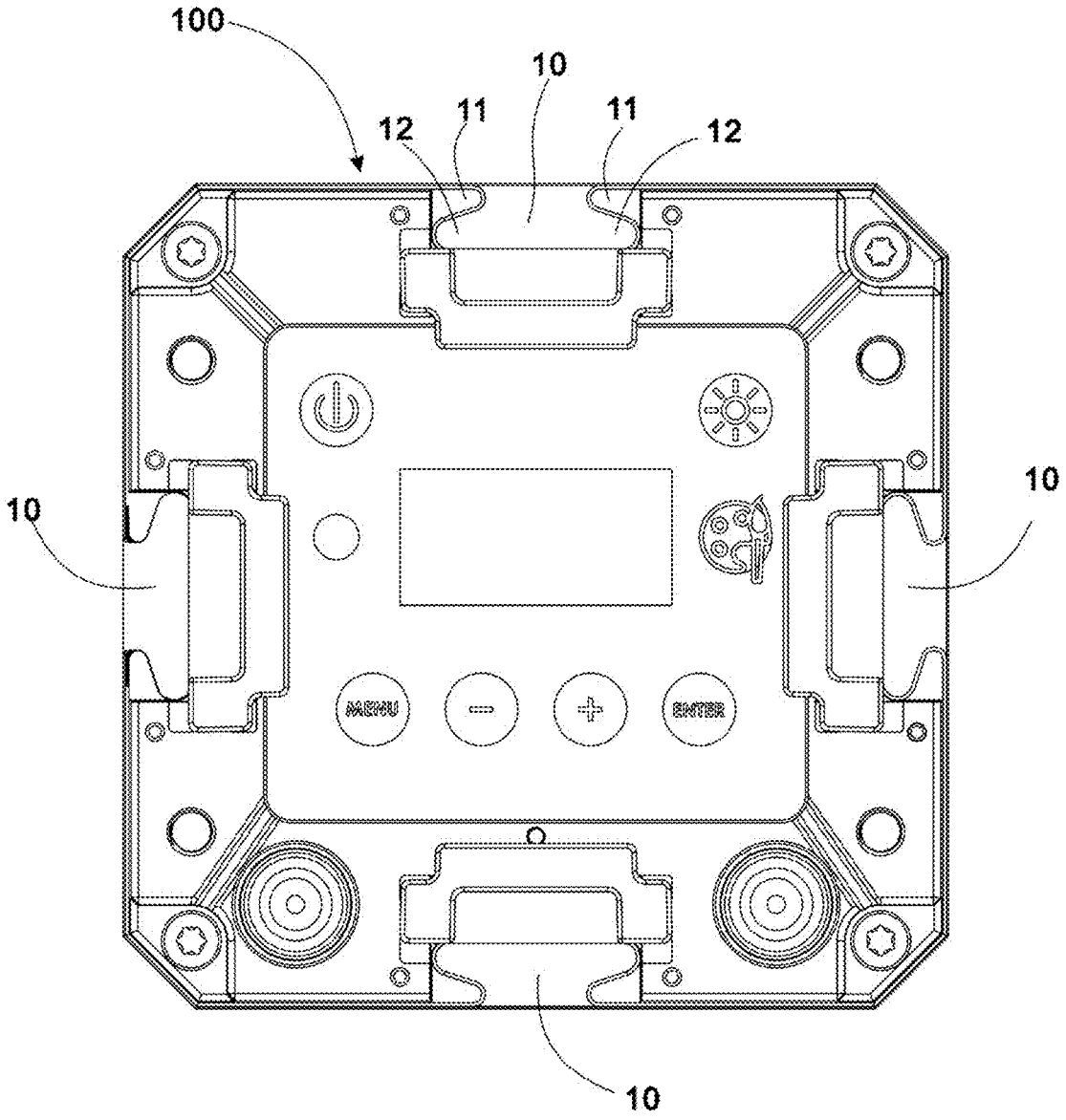
FIG. 2 is a schematic structural diagram of a back of a housing of the luminaire in FIG. 1.

Referring to FIG. 1 and FIG. 2, the disclosure provides a luminaire 100 according to a preferred embodiment, including a housing 1, a light source module 2 arranged in the housing 1, and a connector 3. The housing 1 defines connecting grooves 10 therein, the connector 3 can be inserted into the connecting groove 10, so that detachable connection between the connector 3 and the housing 1 is realized. The connector 3 can be connected to other structural members such as a bracket to mount the luminaire 100 onto other objects such as a support or a girder.

Figure 3:
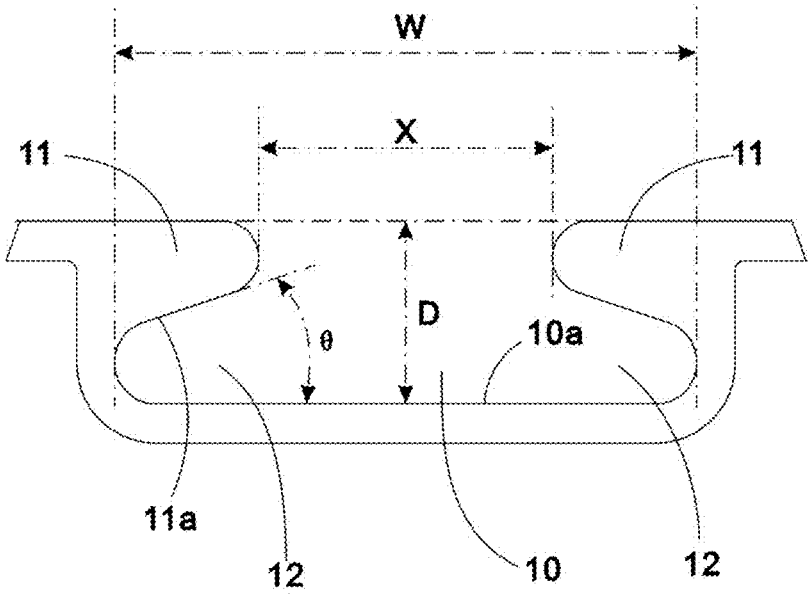
FIG. 3 is a schematic structural diagram of a connecting groove of the housing in FIG. 2.

As shown in FIG. 2 and FIG. 3, the connecting groove 10 is in a strip shape. The connecting groove 10 extends from an outer surface of the housing 1. The connecting groove 10 is flat. One end of the connecting groove 10 is opened for insertion of the connector 3. The connecting groove 10 is provided with a limit portion 11 on each of two opposite side walls of the connecting groove 10. A gap between each limit portion 11 and a bottom surface of the connecting groove 10 forms a channel guide 12. As shown in FIG. 1, the connector 3 is in a strip shape. The connector 3 is provided with a connecting portion 31 on each of two opposite sides of the connector 3. The connecting portion 31 is operable to be inserted into and matched with the channel guide 12 corresponding to the connection portion 31, such that the connecting portion 31 is limited in the channel guide 12 corresponding to the connecting portion 31 via the limit portions 11 corresponding to the connecting portion 31.

Since the connecting groove 10 is a flat shape arranged along the outer surface of the housing 1, its flat geometric structure occupies a small internal space of the luminaire 100, an internal reserved space of the luminaire 100 is large and square, and thus a large component incapable of being reshaped or detached to fit a small or complicated space can be assembled in the housing 1. The connector 3 and the connecting groove 10 are in insertion matching. Through matching between the two connecting portions 31 and the two limit portions 11, the two connecting portions 31 are respectively limited in the two channel guides 12, so that firm and reliable connection is achieved between the connector 3 and the housing 1. Mounting and demounting of the connector 3 and the housing 1 are facilitated by an inserting manner. The entire luminaire 100 may be connected to other supports, girders, or the luminaire 100 through the connector 3.

As shown in FIG. 3, it is to be understood that, the connecting groove 10 described in the disclosure is flat, which involves that a groove depth D thereof is less than a groove width W. Due to the small groove depth D, the internal space of the luminaire 100 occupied by the connecting groove 10 is reduced; due to the relatively large groove width W, the structure of the limit portions 11 and the channel guides 12 in a width direction of the connecting groove 10 can be used to achieve a connection with the connector 3, thereby making a full use of the space along the surface of the housing 1.

Preferably, the groove width W of the connecting groove 10 is 2.5 to 3.5 times of the groove depth D, and is 1.5 to 2.5 times of a gap X between the two limit portions 11, so that the structure of the connecting groove 10 may be as flat as possible, while connection strength between the connecting groove 10 and the connector 30 is ensured.

As shown in FIG. 3, the limit portion 11 has a channel guide face 11*a*, and the channel guide face 11 faces a bottom surface 10*a* of the connecting groove 10. The channel guide face 11*a* is obliquely arranged, and form an acute angle θ with the bottom surface 10*a* of the connecting groove 10. The channel guide face 11*a* and the bottom surface 10*a*, as well as the channel guide face 11*a* and the outer surface of the housing 1, are in curved transition, thereby facilitating machining and shaping, and facilitating assembling between the connecting groove 10 and the connector 3.

In the embodiment, as shown in FIG. 1, the housing 1 is in a columnar shape. A central axis of the housing 1 coincides with a light outgoing direction of the light source module 2. A length direction of the connecting groove 10 is parallel to the central axis of the housing, As such, a light outgoing direction of the luminaire 100 can be conveniently set when the luminaire 100 is mounted onto other objects, thereby facilitating adjustment of the light outgoing direction.

An end opening of the connecting groove 10 faces the back of the housing 1, i.e., is opposite to the light outgoing direction, the connector 3 can be inserted from the back of the luminaire 100 to avoid affecting the structure of the front of the housing 1, thereby ensuring a simple and beautiful appearance of the front of the luminaire 100.

Further, the housing 1 is in a rectangular columnar shape. The housing 1 defines one connecting groove 10 on each of four side faces of the housing 1. Through the four connecting grooves 10, a connection between the housing 1 and other objects can be realized through the connectors 3, and jointing among a plurality of luminaires 100 can also be realized through the connectors 3. Thus, use is facilitated.

Here, in other embodiments, the housing 1 may also be a cylinder, a triangular prism, or other polygonal prisms, and may also be a sphere, a polyhedron, or the like. The number of the connecting grooves 10 may be one, two or more. With two or more connecting grooves 10, the luminaire 100 can be connected to other objects, and jointing among a plurality of luminaires 100 can also be realized.

As shown in FIG. 1, the limit portion 11 is provided with a notch 110 that is communicated to the corresponding channel guide 12. Through the notch 110, a user can observe the internal condition of the channel guide 12 conveniently, and can clean foreign matters entering the channel guide 12, so that normal insertion matching between the connector 3 and the connecting groove 10 is facilitated.

The connector 3 defines a positioning screw hole (not shown in the figure) therein. A positioning screw 34 is operable to be in threaded connection with the positioning screw hole to allow one end portion of the positioning screw 34 to be abutted against the bottom surface 10*a* of the connecting groove 10, such that the connector 3 is positioned in the connecting groove 10. When the connector 3 is inserted in the connecting groove 10, the positioning screw 34 is tightened so that the end portion thereof is abutted against the bottom surface 10*a* of the connecting groove 10, and thus the connector 3 can be positioned in the connecting groove 10 and cannot slip off the connecting groove 10. The positioning screw 34 may be arranged at the position close to an end portion of the connector to prevent other objects blocking the positioning screw 34.

The connector 3 defines a connecting screw hole 30 in a middle position of the along a length direction connector 3. The connecting screw hole 30 is located at a middle position between two connecting portions 31 disposed on the two opposite sides of the connector 3. Through the connecting screw hole 30, a connection between the connector 3 and other structural members may be conveniently realized. For example, threaded connection between the connector 3 and a handwheel 4, or a cardan shaft 8 may be realized. The connecting screw hole 30 is disposed between the two connecting portions 30, so that an influence to matching between the connecting portions 31 and the channel guides 12 can be avoided.

A plurality of connectors 3 may be arranged. The different connectors 3 can be used to connect the connecting grooves 10 on different side faces of the luminaire 100 to different objects. The connector is further provided with a fixing portion 32 on each of the two opposite sides of each connector 3. The fixing portion 32 and the connecting portion 31 cooperate to define a limit groove capable of accommodating the limit portion 11. A connection between the connector 3 and other objects can be facilitated through the fixing portions 32. The two fixing portions 32 may extend away from each other and are in a flat and straight shape. The two fixing portions 32 may extend from one side surface, away from the connecting portion 31, of the connector 3 to form a flat straight surface. As such, it further facilitates fixed connection between the connector 3 and other objects.

Figure 4:
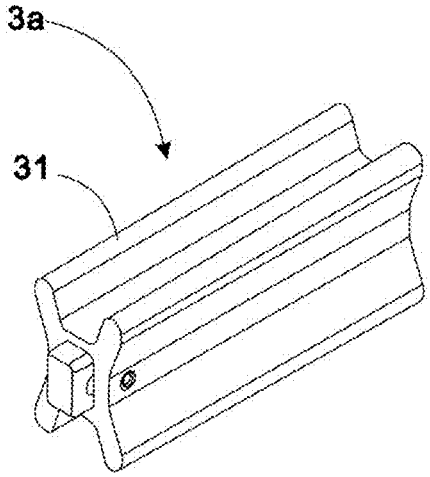
FIG. 4 is a schematic structural diagram of a connecting pin of a luminaire of the disclosure.
Figure 5:
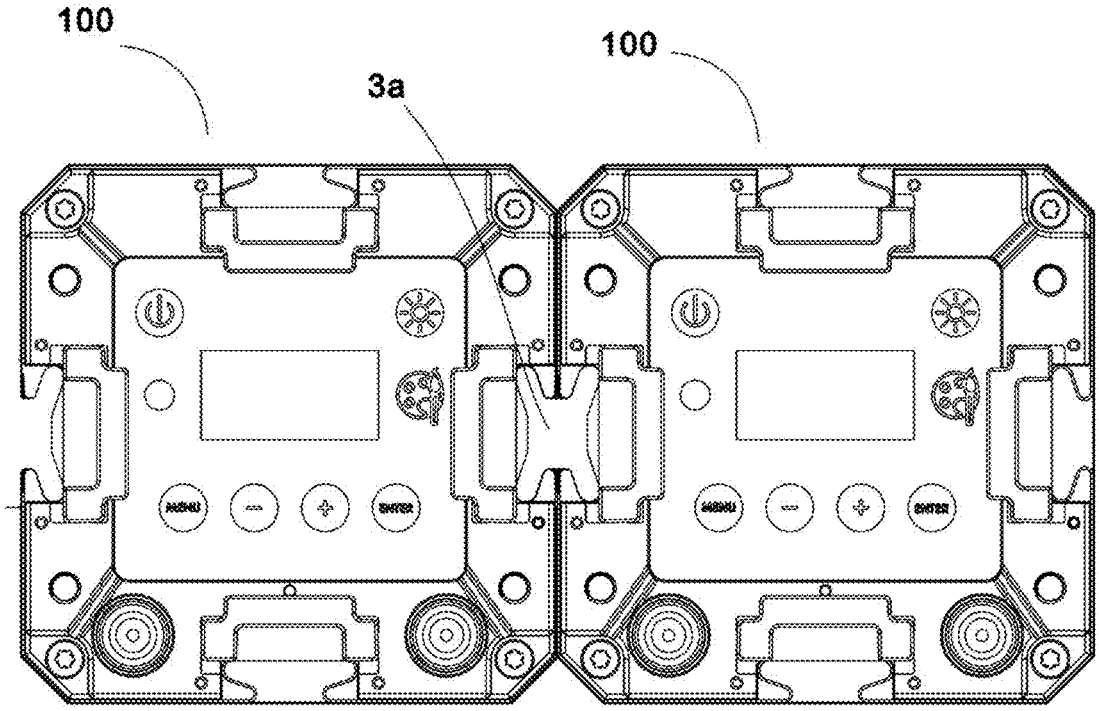
FIG. 5 is a schematic structural diagram of jointing the luminaires of the disclosure into a luminaire combination by the connecting pin.

Alternatively, the fixing portion 32 of the connector 3 may have the same shape and size as the connecting portion 31. The fixing portion 32 is operable to be inserted into and matched with the channel guide 12, which is equivalent to providing four connecting portions 31. As shown in FIG. 4, the entire connector 3 may serve as a connecting pin 3*a* for connecting the housing 1 of the luminaire 100 to a housing of another luminaire 100. As such, it is possible to realize inserted connection with the connecting groove 10 of another luminaire 100. As shown in FIG. 5, the connecting grooves 10 of the two luminaires 100 can be simultaneously connected by the connecting pin 3*a*, so that the two luminaires 100 are jointed together. By means of a plurality of connecting pins 3*a*, a plurality of luminaires 100 can be joined together to form a modular structure. The luminaires 100 in different number as needed can be jointed to form a luminaire combination of different size and different lighting area. A dovetail groove is further arranged between the two connecting portions 31, which can reduce consumable of the connecting pin 3*a*. The connecting pin 3*a* is preferably a solid aluminum part, which is convenient to machine and shape and can ensure the connection strength.

Figure 6:
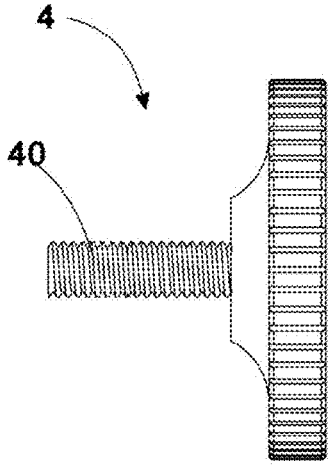
FIG. 6 is a schematic structural diagram of a handwheel of a luminaire of the disclosure.

As shown in FIG. 6, the luminaire 100 further includes a handwheel 4. The handwheel is provided with a handle screw 40 at a position of a central axis of the handwheel 4. The handle screw is operable to be in threaded connection with the connecting screw hole 30. Through threaded connection between the handle screw 40 and the connecting screw hole 30, other objects can be cluminaireed between the handwheel 4 and the connector 3, so that fixed connection between the luminaire 100 and the other objects is realized.

The disclosure further provides a luminaire combination, including two or more of the above-mentioned luminaires 100. The luminaire combination further includes at least one of a bracket 5, an adjusting plate 6, a hinge 7, and a cardan shaft 8. The bracket 5, the adjusting plate 6, the hinge 7, and the cardan shaft 8 each can be connected to the connector 3 of the luminaire 100. A plurality of luminaires 100 may be combined and jointed to form different shapes of luminaire combinations through one or multiple of the bracket 5, the hinge 7, the adjusting plate 6, and the cardan shaft 8. The bracket 5, the adjusting plate 6, the hinge 7, and the cardan shaft 8 will be respectively described below.

Figure 7:
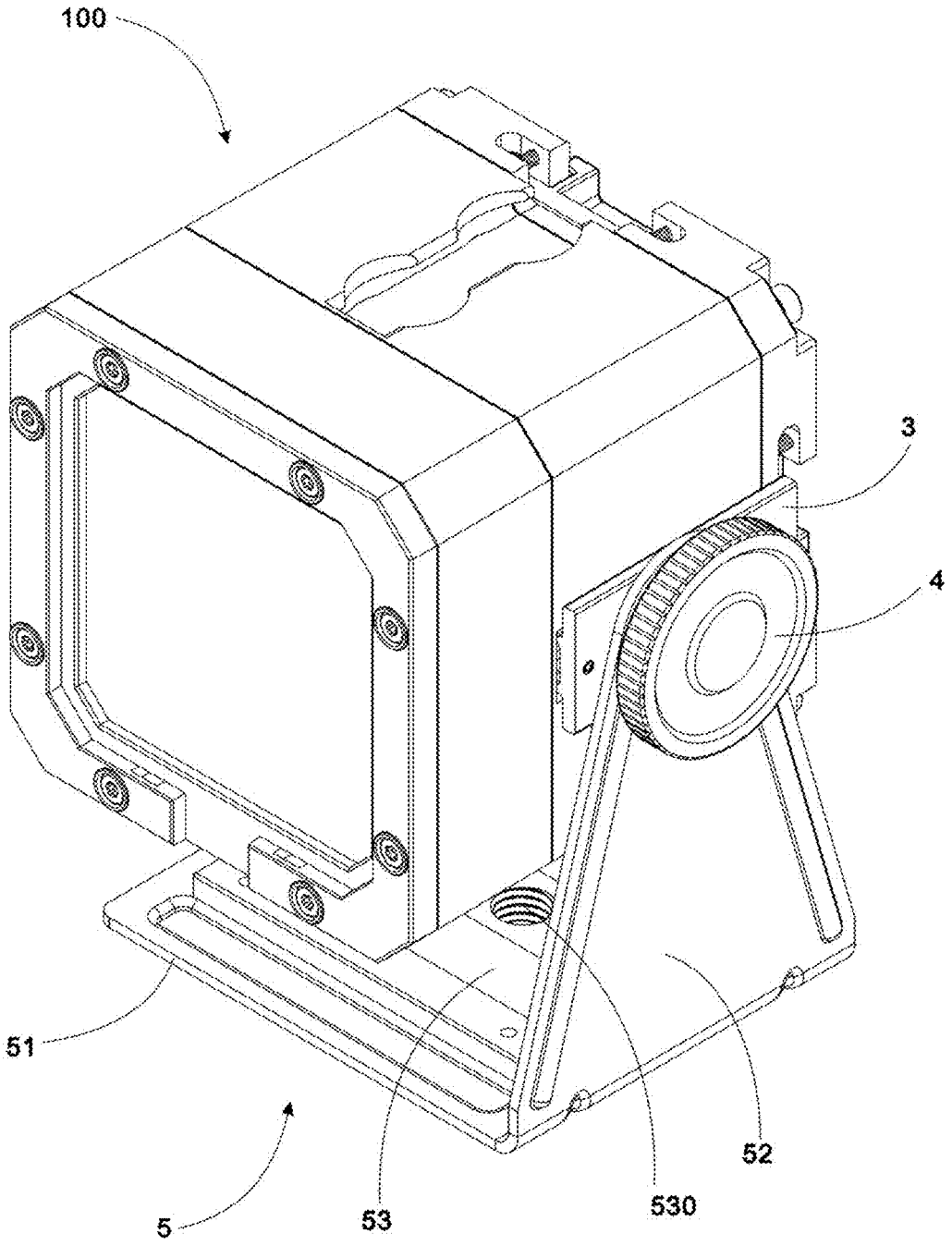
FIG. 7 is a schematic structural diagram of a connection between a luminaire and a bracket of the disclosure.
Figure 8:
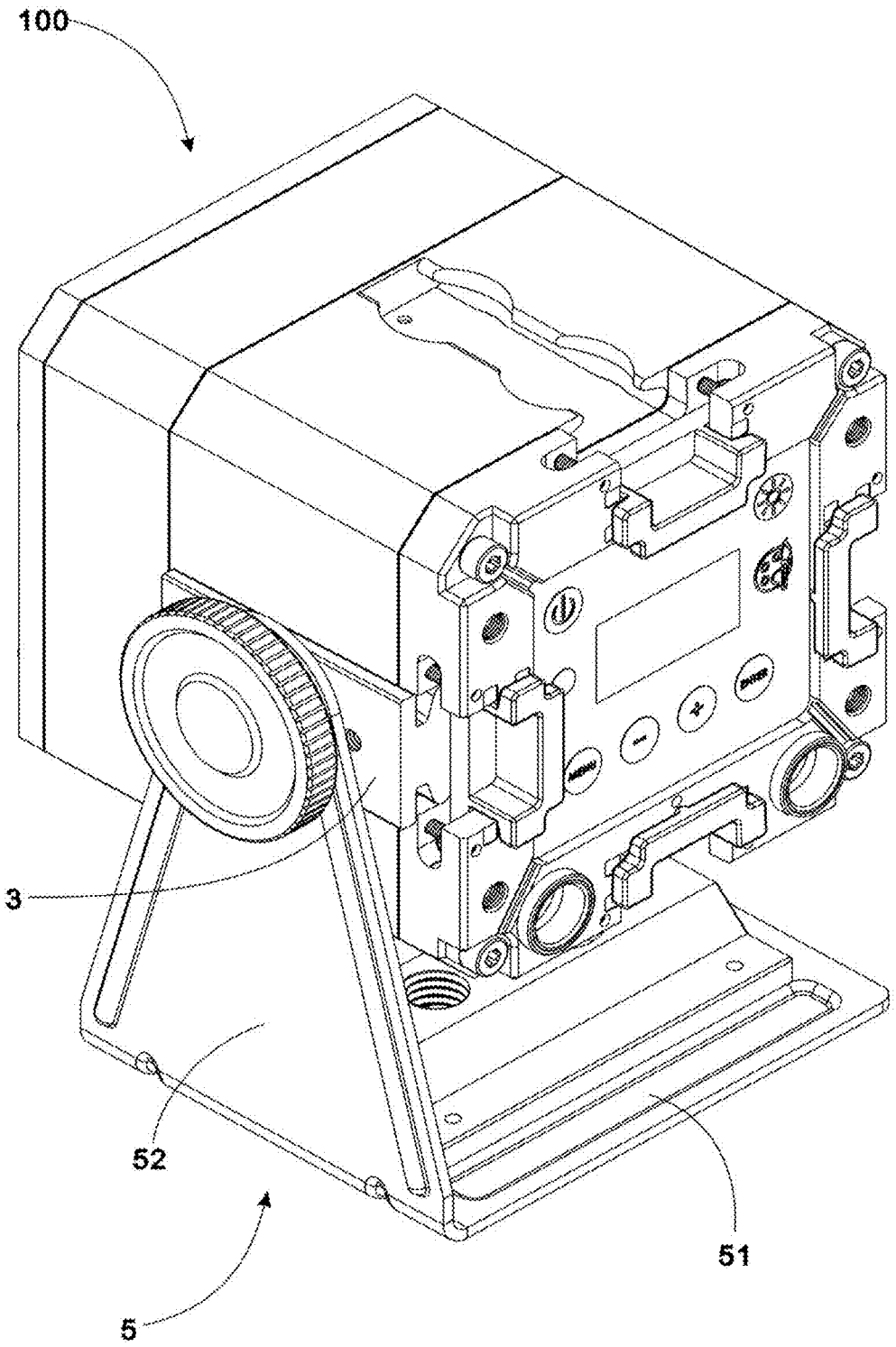
FIG. 8 is a schematic structural diagram of the connection between the luminaire and the bracket in FIG. 7 from another perspective.

As shown in FIG. 7 and FIG. 8, the bracket 5 is a bent plate in an L shape and has two arms which serve as a base plate 51 and a connecting plate 52, respectively. The base plate 51 is in square shape. The connecting plate 52 is in a triangular shape. The connector 3 is disposed at the connecting plate 52. The connecting plate 52 defines a connecting hole (not shown in the figure) at a tip end, far away from the base plate 51, of the connecting plate 52. A handle screw 40 of the handwheel 4 penetrates the connecting hole to be in threaded connection with the connecting screw hole 30 of the connector 3. The handle screw 40 is screwed into the connecting screw hole 30 of the connector 3 to be used as a brake, so that the connector 3 is rotated to adjust an angle between the connector 3 and the bracket 5, to adjust a light projection angle of the luminaire 100. The connecting plate 52 is fixed and cluminaireed between the handwheel 4 and the connector 3, so that fixed connection between the connector 3 and the bracket 5 is realized. The connecting plate 52 is triangular, which can avoid blocking the positioning screw 34. The connector 3 is inserted into the connecting groove 10, and the positioning screw is screwed on, so that fixed connection between the luminaire 100 and the bracket 5 can be realized. The base plate 51 is provided with a connecting block 53. The connecting block 53 is provided with a bracket screw hole 530. The bracket screw hole 530 has the same structure as the connecting screw hole, so that component universality is improved. The bracket screw hole 530 may be used to facilitate threaded connection with the cardan shaft 8 or other objects.

The bracket 5 is generally used with the luminaire 100 individually, or serves as a coupler between the luminaire 100 or a luminaire combination and a holder, especially when the cardan shaft 8 is required.

Figure 9:
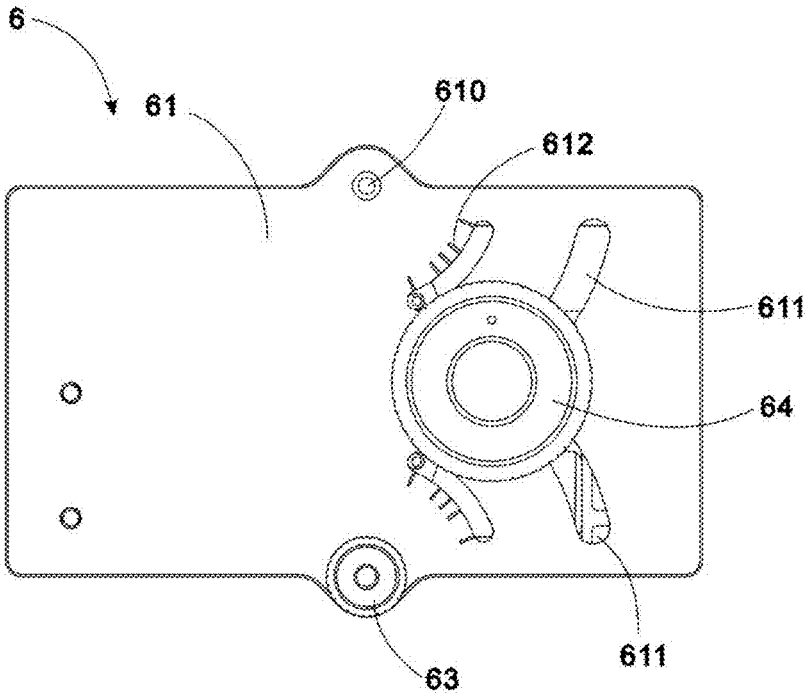
FIG. 9 is a schematic structural diagram of a front of an adjusting plate of a luminaire combination of the disclosure.
Figure 10:
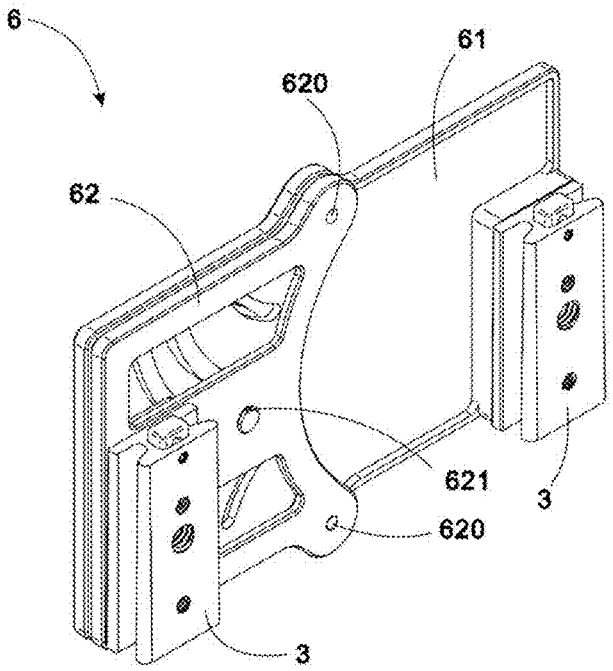
FIG. 10 is a three-dimensional structure schematic diagram of the adjusting plate in FIG. 9.
Figure 11:
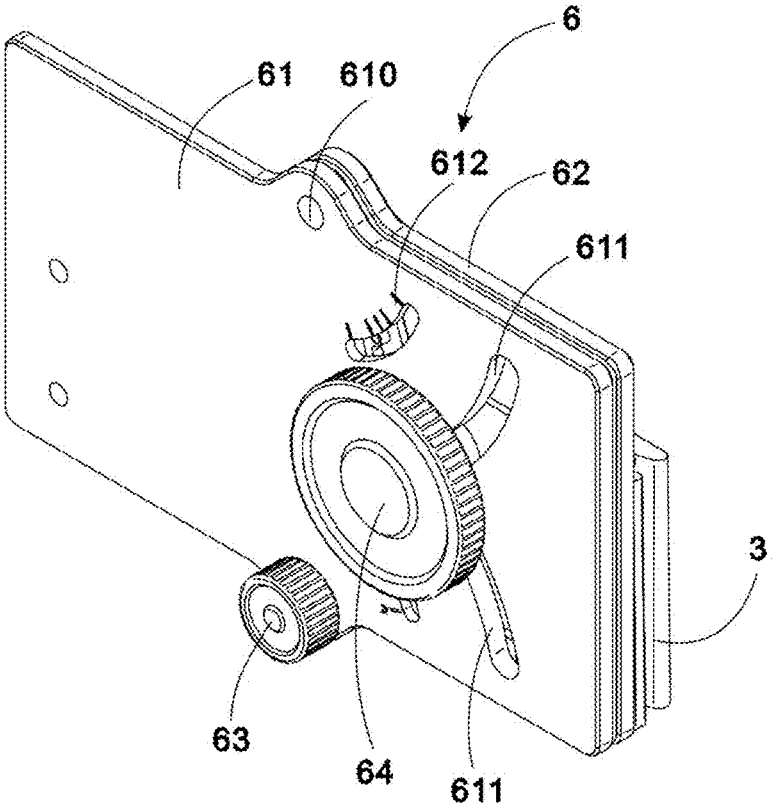
FIG. 11 is a three-dimensional structure schematic diagram of the adjusting plate in FIG. 9 from another perspective.

The adjusting plate 6 is mainly used for a cross-shaped luminaire combination to achieve straight, divergent, or condensed light projection directions. As shown in FIG. 9, FIG. 10, and FIG. 11, the adjusting plate 6 includes a first bearing plate 61, a second bearing plate 62, an adjusting handwheel 64, and a knurled screw 63. The first bearing plate 61 and the second bearing plate 62 are arranged in parallel. The first bearing plate 61 is in a rectangular shape. One connector 3 of one luminaire is disposed at one short edge of the first bearing plate 61. The second bearing plate 62 is arranged at the other short edge of the first bearing plate 61 and another connector 3 is disposed at the second bearing plate 62. The first bearing plate 61 defines a rotating through hole 610 at a long edge thereof. The second bearing plate 62 defines a rotating screw hole 620 at a position thereof corresponding to the rotating through hole 610. The knurled screw 63 penetrates the rotating through hole 610 to be in threaded connection with the rotating screw hole 620, so that a plate aligning hinge point is formed, i.e., a hinged point between the first bearing plate 61 and the second bearing plate 62 is formed. The knurled screw 63 serves as a pivot between the two plates, so that the first bearing plate 61 and the second bearing plate 62 may rotate relative to each other. The first bearing plate 61 defines a guide hole 611 in an arc-strip shape. The second bearing plate 62 defines an adjusting screw hole 621 at a position of the second bearing plate corresponding to the guide hole 611. An adjusting screw rod (not shown in the figure) is arranged at a position of a central axis of the adjusting handwheel 64. The adjusting screw rod penetrates the guide holes 611 to be in threaded connection with the adjusting screw hole 621. When the adjusting handwheel 64 is loosened by turning, the first bearing plate 61 and the second bearing plate 62 may rotate relative to each other, and the adjusting screw rod moves along the guide holes 611. When the adjusting handwheel 64 is tightened by turning, the first bearing plate 61 is cluminaireed between a wheel body and the second bearing plate 62, and positions of the first bearing plate 61 and the second bearing plate 62 are fixed. The adjusting handwheel 64 and the adjusting screw hole 621 are matched to form a brake, which can adjust the relative position between the first bearing plate 61 and the second bearing plate 62, so that the relative position between two connectors 3 can be adjusted, and further, the relative position between two luminaires 100 can be adjusted, thereby changing light projection angles of the two luminaires 100.

Further, both long edges of the first bearing plate 61 are provided with the rotating through holes 610, correspondingly, the second bearing plate 62 is provided with two rotating screw holes 620, and the first bearing plate 61 is provided with two guide holes 611. The knurled screw 63 may be detached from one of the rotating screw holes 620 and mounted into the other rotating screw hole 620, so that a rotating shaft between the first bearing plate 61 and the second bearing plate 62 may be changed to achieve adjustment of different angle directions between the two luminaires 100.

Since the first bearing plate 61 of the adjusting plate 6 is provided with angle mark slots 612, an opening angle can be accurately set, thereby facilitating adjustment to make angles, relative to the luminaire 100 at the center position, of the surrounding four luminaires 100 the same.

Figure 12:
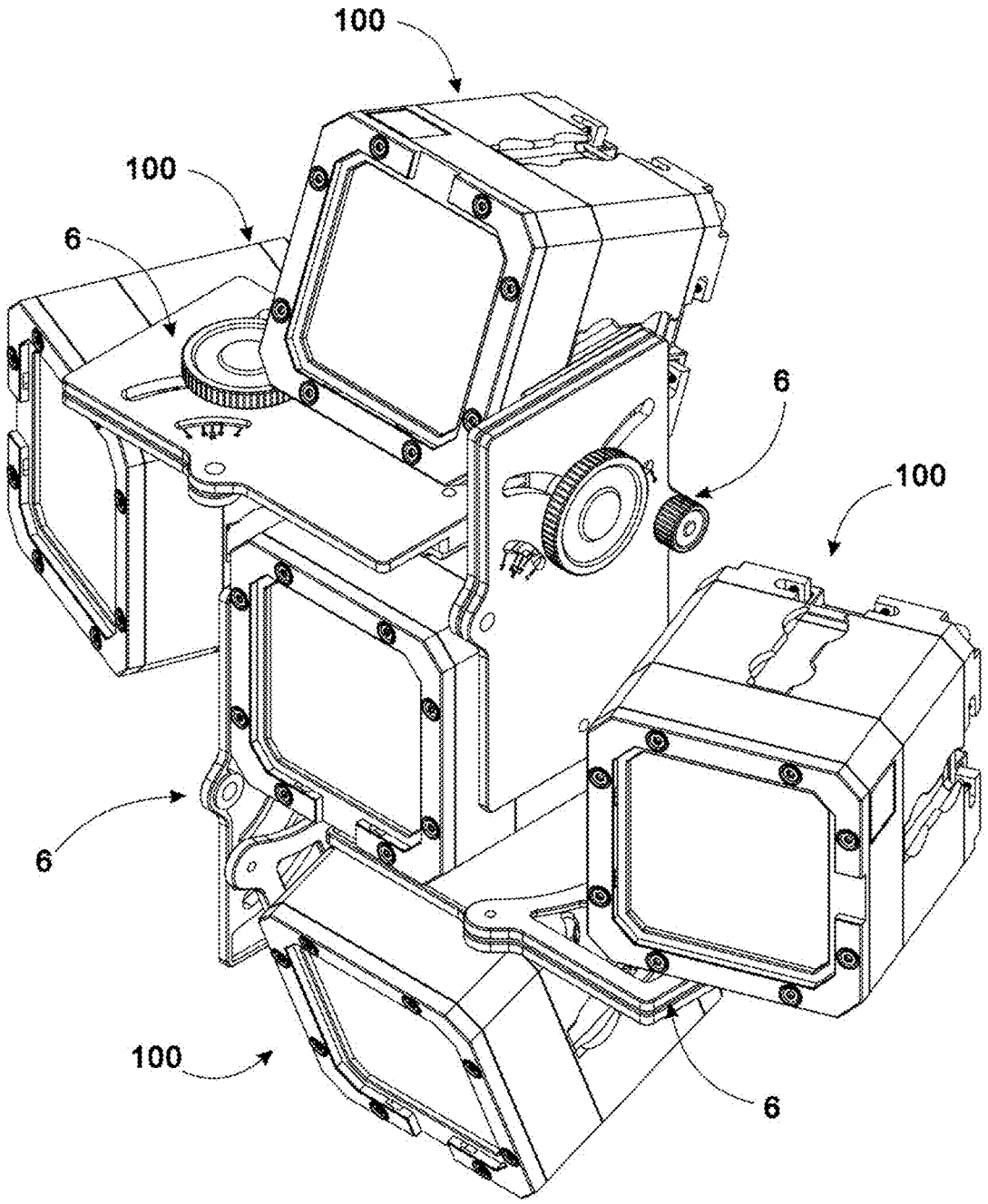
FIG. 12 is a schematic structural diagram of a luminaire combination formed by luminaires and adjusting plates of the disclosure.
Figure 13:
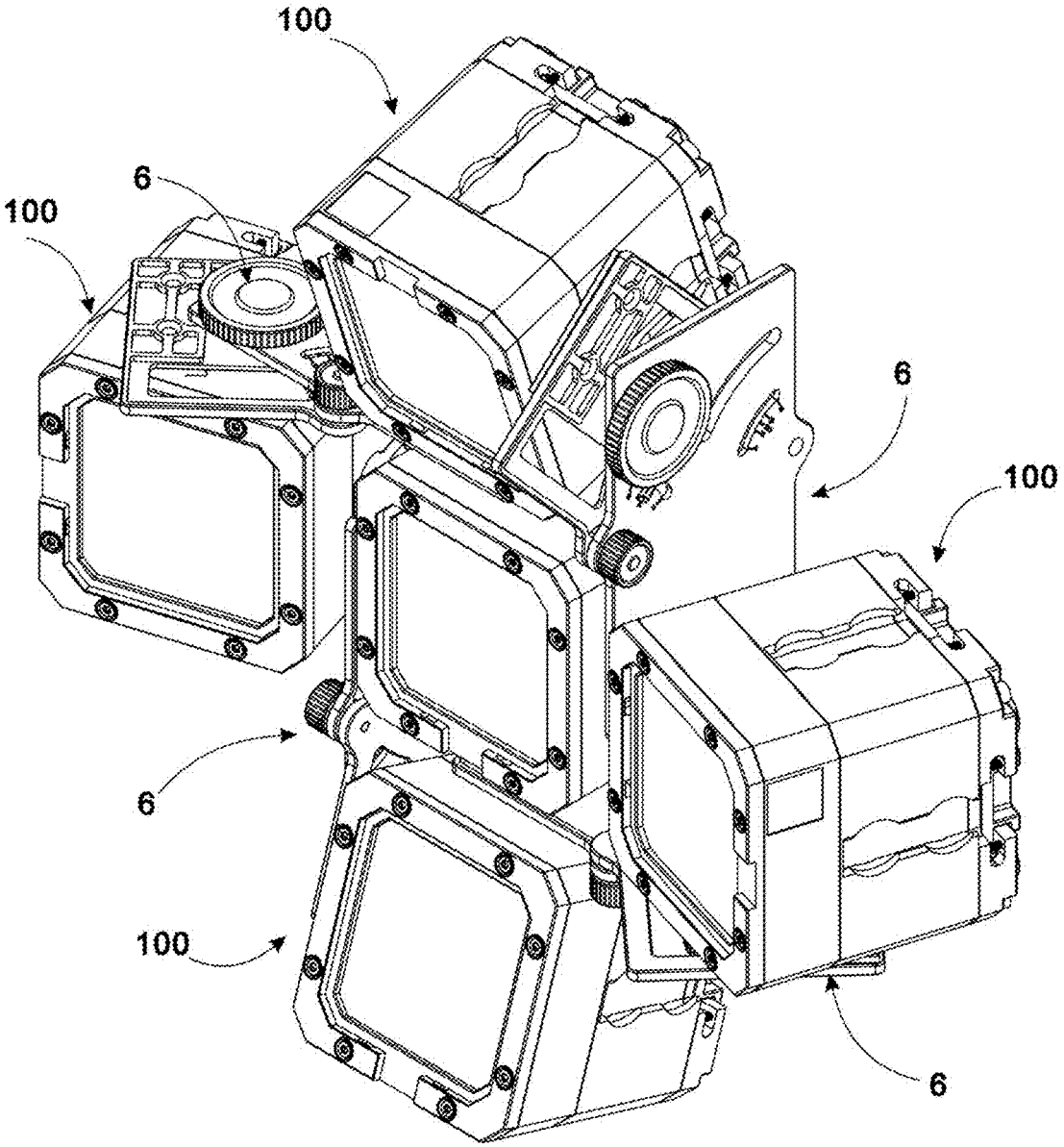
FIG. 13 is a schematic structural diagram of the luminaire combination in FIG. 12 in another state.

As shown in FIG. 12 and FIG. 13, four adjusting plates 6 and five luminaires 100 are used to form a luminaire combination. Four luminaires 100 may be adjustably arranged on four side faces of one luminaire 100, and by adjusting the first bearing plate 61 and the second bearing plate 62 to rotate relative to each other, overall light condensing or diverging of the luminaire combination formed of the five luminaires 100 can be achieved.

Figure 14:
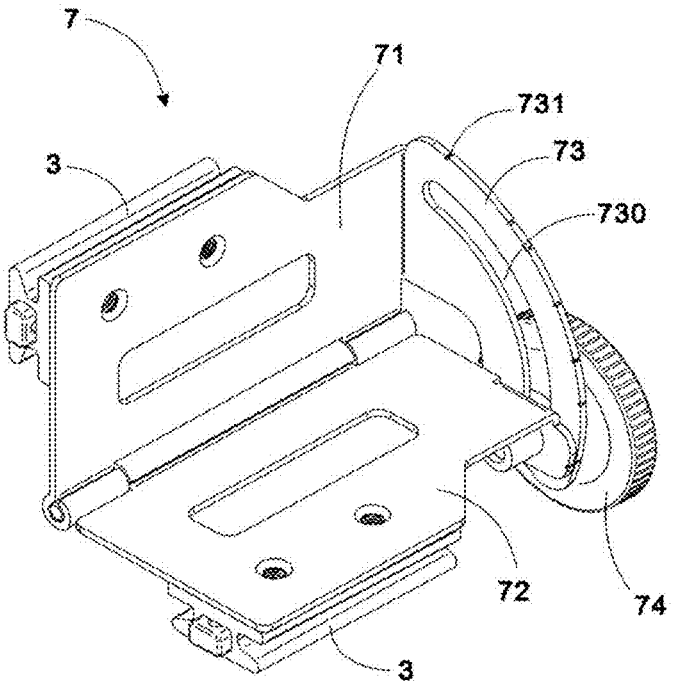
FIG. 14 is a three-dimensional structure schematic diagram of a hinge of a luminaire combination of the disclosure.
Figure 15:
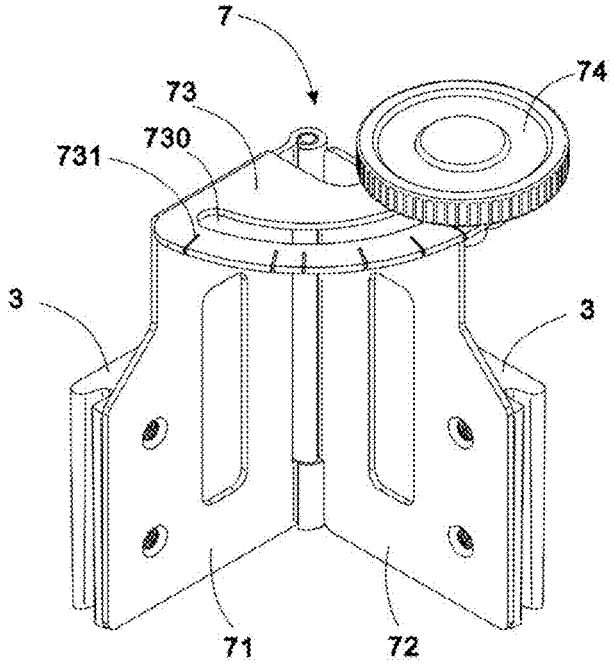
FIG. 15 is a three-dimensional structure schematic diagram of the hinge in FIG. 14 from another perspective.
Figure 16:
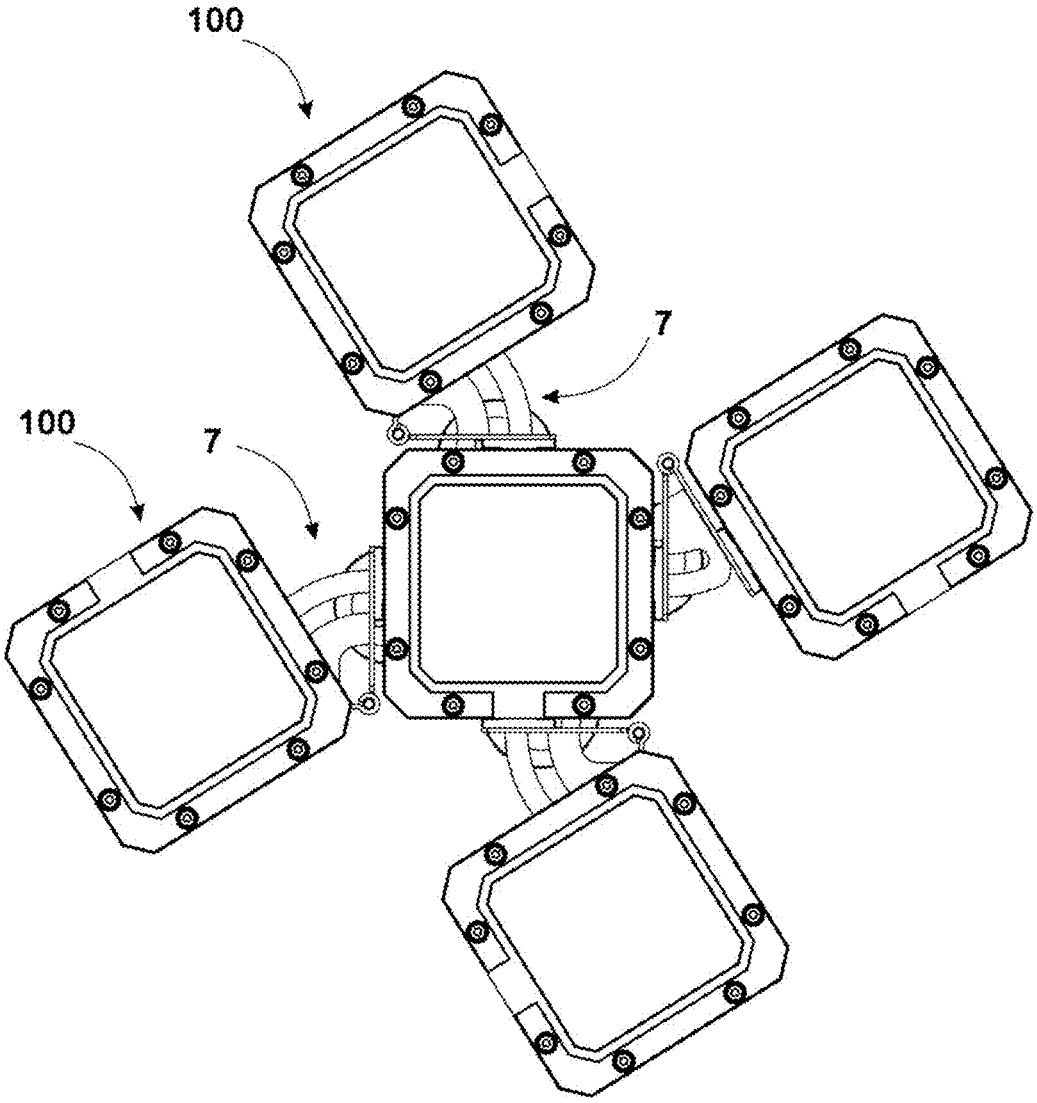
FIG. 16 is a schematic structural diagram of a luminaire combination formed by luminaires and hinges of the disclosure.
Figure 17:
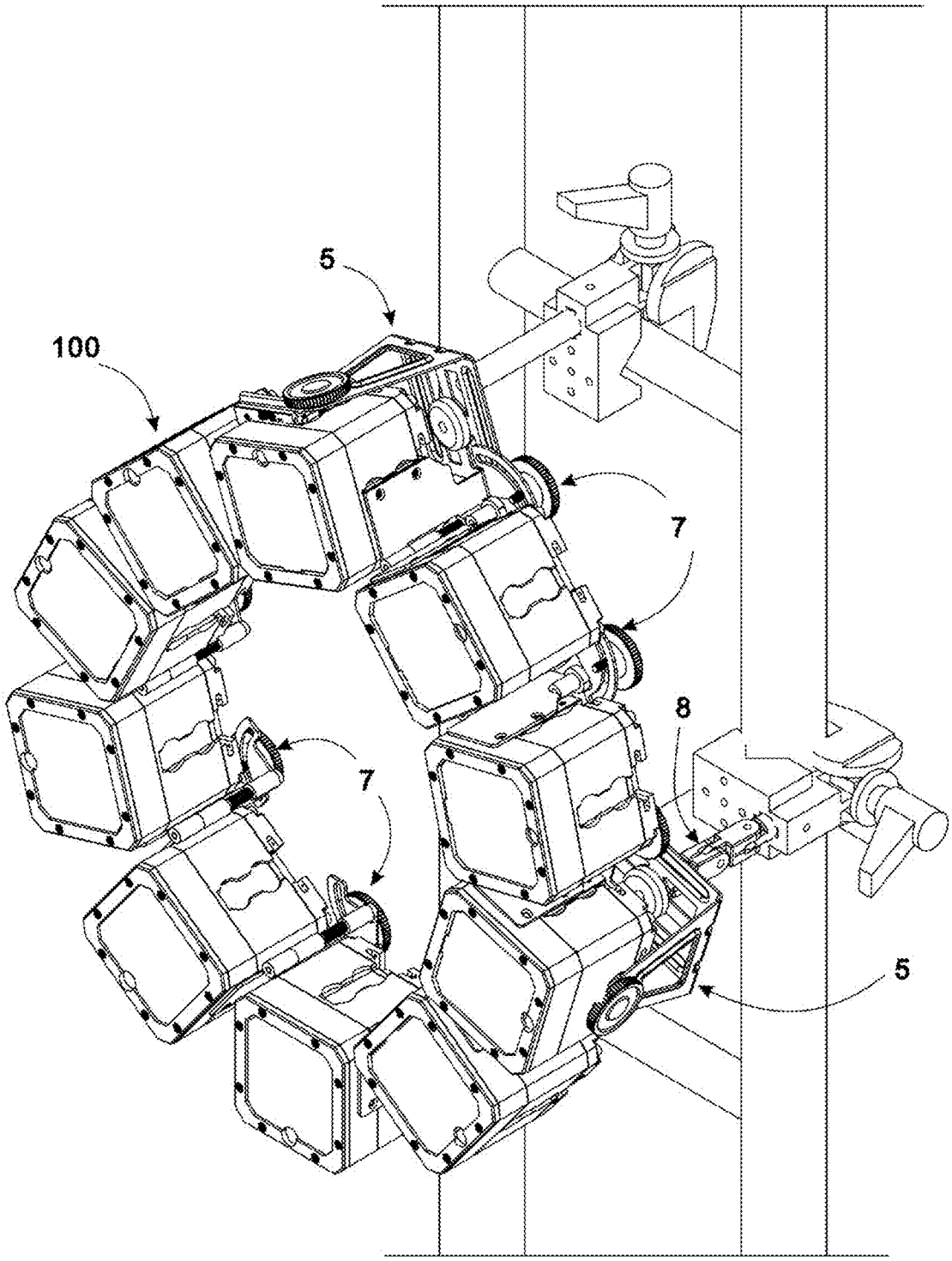
FIG. 17 is a schematic structural diagram of another form of luminaire combination formed by luminaires and hinges of the disclosure.

The hinge 7 is used as a connection structural member, and can be used for adjustable connection between two luminaires 100. As shown in FIG. 14 and FIG. 15, the hinge 7 includes a first hinge plate 71, a second hinge plate 72, and a hinge handwheel 74. The first hinge plate 71 and the second hinge plate 72 are hinged at their edges. One connector 3 of one luminaire 100 is disposed at the first hinge plate 71 and one connector 3 of another luminaire 100 is disposed at the second hinge plate 72. A length direction of each connector 3 is parallel to a pivot between the first hinge plate 71 and the second hinge plate 72. A brake plate 73 is fixed on the first hinge plate 71. The brake plate 73 is perpendicular to the pivot between the first hinge plate 71 and the second hinge plate 72, and defines a hinge hole 730 in an arc-strip shape. A portion, corresponding to the brake plate 73, of the second hinge plate 72 is bent and defines a hinge screw hole (not shown in the figure) therein. A hinge screw rod (not shown in the figure) is arranged at a position of a central axis of the hinge handwheel 74. The hinge screw rod penetrates the hinge hole 730 to be in threaded connection with the hinge screw hole. When the hinge handwheel 74 is loosened by turning, the first hinge plate 71 and the second hinge plate 72 may rotate relative to each other, the hinge screw rod moves along the hinge hole 730. When the hinge handwheel 74 is tightened by turning, the brake plate 73 is clamped between the hinge handwheel 74 and the second hinge plate 72, and positions of the first hinge plate 71, the brake plate 73, and the second hinge plate 72 are fixed. The hinge handwheel 74 and the hinge screw hole are matched to form a brake, which can adjust a relative angle between the two plates. In the hinge 7 according to the embodiment, the first hinge plate 71 and the second hinge plate 72, provided with the connectors 3, rotate around the pivot parallel to the plates, so that the opening degree of the two plates can be changed to adjust the relative position of the two luminaires 100. The brake plate 73 of the hinge 7 is provided with degree scale marks 731, which can achieve setting of the same angle. As shown in FIG. 16, with one luminaire 100 as the center, four hinges 7 and four luminaires are used on four sides of the luminaire 100 to form a cross-shaped luminaire combination. As shown in FIG. 17, a plurality of luminaires 100, a plurality of hinges 7, brackets 5, and cardan shafts 8 are used to form a circular luminaire combination.

Figure 18:
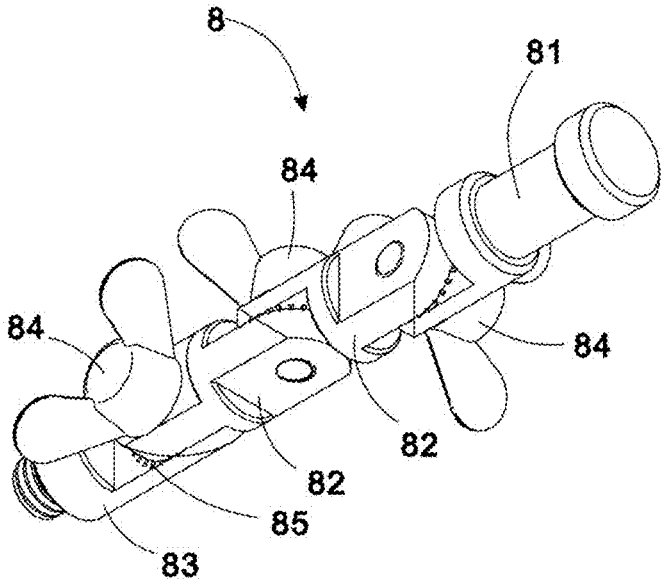
FIG. 18 is a three-dimensional structure schematic diagram of a cardan shaft of a luminaire combination of the disclosure.
Figure 19:
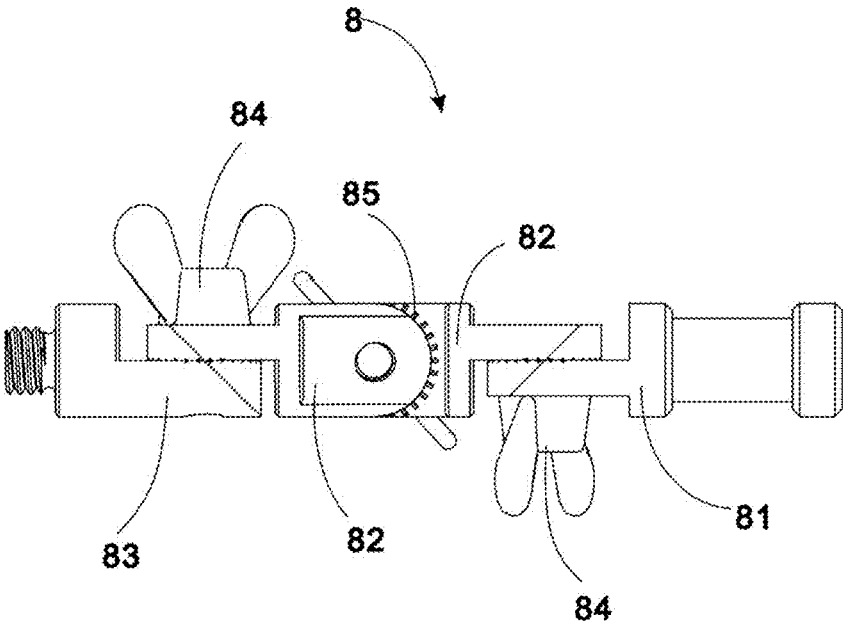
FIG. 19 is a schematic structural diagram of the cardan shaft in FIG. 18 from another perspective.

As shown in FIG. 18 and FIG. 19, the cardan shaft 18 is provided with three rotating shafts, which can flexibly connect the bracket 5 of the luminaire 100 or a luminaire combination to a support or a girder, or other objects. The cardan shaft 8 includes a fixed end 81, two intermediate parts 82, and a free end 83 which are sequentially rotationally connected. The fixed end 81 is used to be connected to other objects such as a support or a girder, and the free end 83 may be used to be connected to the connector 3 or the bracket 5. In the embodiment, the fixed end 81 adopts an industrial standard plug, and is matched with a general standard clamp on the girder or the support. The free end 83 is provided with an external thread matched with the connecting screw hole 30 of the connector 3, so that a connection with the luminaire 100 is achieved.

One wing handle screw 84 is arranged between the fixed end 81 and one intermediate part 82, one wing handle screw 84 is arranged between the two intermediate parts 82, and one wing handle screw 84 is arranged between the other intermediate part 82 and the free end 83. The three wing handle screws 84 may provide three rotating shafts, and at least one of the three rotating shafts is perpendicular to the other two rotating shafts. In this way, universal adjustment is achieved. The three wing handle screws 84 can be loosened or tightened manually easily, without the aid of tools. Positioning teeth 85 for preventing relative rotation are arranged between the fixed end 81 and one intermediate part 82 as well as between the two intermediate parts 82, and between the other intermediate 82 and the free end 83, which can prevent relative rotation after tightening.

In the luminaire and the luminaire combination provided in the disclosure, with a flat channel guide structure of each connecting groove 10, interference to the internal mounting space of the luminaire is minimized, the internal reserved space of the luminaire is large and square, and thus a large component incapable of being reshaped or detached to fit a small or complicated space can be assembled.

The connector 3 or the connecting pin 3*a* is matched with the connecting groove 10 of the housing 1 by inserting, the connector 3, is in matched connection with the bracket 5, the hinge 7, the adjusting plate 6, or the cardan shaft 8, and all four side faces of the housing 10 are provided with the connecting grooves 10. Aligning and combining of a plurality of luminaires can be achieved by using the connecting pins 3*a*, the hinges 7, and the adjusting plates 6. With the compact structure of the connecting pin 3*a*, the luminaires can be assembled with the maximum density of zero spacing. With the connecting pins 3*a* and the brackets 5, a compact linear combination can be formed; with the hinges 7, a cross-shaped or a circular combination can be formed; with the adjusting plates 6, a linear or a cross-shaped combination in a diverging direction can be formed. Aligning and fixing of a plurality of luminaires can be achieved through the brackets 5 and the cardan shafts 8. A plurality of luminaires 100 can be combined into a line, a cross shape or a circle as needed, and can be combined into various shapes of luminaire combinations. Thus, unlimited combination possibilities are provided for the luminaires 100.

The handwheel 4, the adjusting handwheel 64, and the hinge handwheel 74 each can be matched with the corresponding screw hole to form a brake. Brakes can also be formed at positions of the wing handle screws 84 of the cardan shaft 8. After the luminaires are combined, light effects of the luminaire combination such as condensing, diverging, or in any other directions can be achieved by adjusting a vertical axis of each single luminaire, so that high flexibility in light direction and arrangement of the luminaire combination can be achieved. The luminaire combination can be connected to the support or the girder through a single connector or a plurality of joint points. Free alignment or any adjustment can be achieved through the brackets 5, the hinges 7, the adjusting plates 6, or the cardan shafts 8.

The handwheel 4, the adjusting handwheel 4, and the hinge handwheel 74 may have the same shape and size, especially have the same external thread structure, which allow the three to form general components, thereby achieving exchange to facilitate mounting and using.

The connecting accessories such as the brackets 5, the hinges 7, the adjusting plates 6 and the cardan shafts 8 each have simple structure, small size, and small space occupation, can avoid use of luminaire brackets with excessive space occupation, thereby facilitating forming of a compact spotlight array.

In summary, although the disclosure has been disclosed as above in the preferred embodiments, the above preferred embodiments are not intended to limit the disclosure. Those of ordinary skill in the art can make variations and modifications without departing from the spirit and scope of the disclosure, and the protection scope of the disclosure is subject to the scope defined by the claims.

What is claimed is:

1. A luminaire combination, comprising at least two luminaires and an adjusting plate, a distance between each two adjacent luminaires being adjustable through the adjusting plate, wherein each of the at least two luminaires comprises a housing and a light source module received in the housing, wherein:

the housing defines a connecting groove therein, wherein the connecting groove is in a flat strip shape and extends from an outer surface of the housing;

the luminaire further comprises a connector in a strip shape, wherein one end of the connecting groove is opened for insertion of the connector, the connecting groove is provided with a limit portion on each of two opposite side walls thereof, and a gap between each limit portion and a bottom surface of the connecting groove forms a channel guide; and the connector is provided with a connecting portion on each of two opposite sides thereof, and the connecting portion is operable to be inserted into and matched with the channel guide corresponding to the connection portion, such that the connecting portion is limited in the channel guide corresponding to the connecting portion via the limit portion corresponding to the connecting portion; and the adjusting plate comprises a first bearing plate in a rectangular shape, a second bearing plate, an adjusting handwheel, and a knurled screw; wherein:

the first bearing plate and the second bearing plate are arranged in parallel;

one connector of one luminaire is disposed at one short edge of the first bearing plate, the second bearing plate is arranged at the other short edge of the first bearing plate and another connector is disposed at the second bearing plate;

the first bearing plate defines a rotating through hole at a long edge thereof, the second bearing plate defines a rotating screw hole at a position thereof corresponding to the rotating through hole, and the knurled screw penetrates the rotating through hole to be in threaded connection with the rotating screw hole, so as to form a hinge point between the first bearing plate and the second bearing plate; and the first bearing plate defines a guide hole in an arc-strip shape, the second bearing plate defines an adjusting screw hole at a position of the second bearing plate corresponding to the guide hole, an adjusting screw rod is arranged at a position of a central axis of the adjusting handwheel, and the adjusting screw rod penetrates the guide holes to be in threaded connection with the adjusting screw hole.

2. The luminaire combination according to claim 1, wherein the housing is in columnar shape, a central axis of the housing coincides with a light outgoing direction of the light source module, and a length direction of the connecting groove is parallel to the central axis of the housing.

3. The luminaire combination according to claim 2, wherein the housing is in a rectangular columnar shape, and defines one connecting groove on each of four side faces of the housing.

4. The luminaire combination according to claim 1, wherein the connector defines a positioning screw hole therein; and a positioning screw is operable to be in threaded connection with the positioning screw hole to allow an end portion of the positioning screw to be abutted against the bottom surface of the connecting groove, such that the connector is positioned in the connecting groove.

5. The luminaire combination according to claim 1, wherein the connector defines a connecting screw hole in a middle position along a length direction of the connector, and the connecting screw hole is located at a middle position between two connecting portions disposed on the two opposite sides of the connector.

6. The luminaire combination according to claim 5, wherein the luminaire further comprises a handwheel, the handwheel is provided with a handle screw at a position of a central axis of the handwheel, and the handle screw is operable to be in threaded connection with the connecting screw hole.

7. The luminaire combination according to claim 1, wherein the connector is further provided with a fixing portion on each of the two opposite sides of the connector, and the fixing portion and the connecting portion cooperate to define a limit groove capable of accommodating the limit portion.

8. The luminaire combination according to claim 7, wherein the two fixing portions extend away from each other and are in a flat and straight shape, and extend from one side surface, away from the connecting portion, of the connector to form a flat straight surface.

9. The luminaire combination according to claim 7, wherein the fixing portion and the connecting portion are of the same shape and size, the fixing portion is operable to be inserted into and matched with the channel guide, such that the connector serves as a connecting pin for connecting the housing the luminaire to a housing of another luminaire.

10. The luminaire combination according to claim 1, further comprising a bracket, wherein the bracket is a bent plate in an L shape and has two arms which serve as a base plate in a square shape and a connecting plate in a triangular shape, respectively;

the connector of the luminaire is disposed at the connecting plate;

the connecting plate defines a connecting hole at a tip end, away from the base plate, of the connecting plate; and a handle screw of a handwheel penetrates the connecting hole to be in threaded connection with the connecting screw hole of the connector.

11. The luminaire combination according to claim 1, further comprising a hinge, wherein the hinge comprises a first hinge plate, a second hinge plate, and a hinge handwheel, the first hinge plate and the second hinge plate are hinged at their edges;

one connector of one luminaire is disposed at the first hinge plate and one connector of another luminaire is disposed at the second hinge plate, and a length direction of each connector is parallel to a pivot between the first hinge plate and the second hinge plate;

a brake plate is fixed on the first hinge plate, wherein the brake plate is perpendicular to the pivot between the first hinge plate and the second hinge plate and defines a hinge hole in an arc-strip shape, and a portion of the second hinge plate corresponding to the hinge hole is bent and defines a hinge screw hole therein; and a hinge screw rod is arranged at a position of a central axis of the hinge handwheel, wherein the hinge screw rod penetrates the hinge hole to be in threaded connection with the hinge screw hole.

12. The luminaire combination according to claim 1, further comprising a cardan shaft, wherein the cardan shaft comprises a fixed end, two intermediate parts, and a free end sequentially rotationally connected; and one wing handle screw is arranged between the fixed end and one intermediate part, one wing handle screw is arranged between the two intermediate parts, one wing handle screw is arranged between the other intermediate part and the free end, and the three wing handle screws provide three rotating shafts, and at least one of the three rotating shafts is perpendicular to the other two rotating shafts.

13. A luminaire combination, comprising at least two luminaires and a hinge, a distance between each two adjacent luminaires being adjustable through the hinge, wherein each of at least two luminaires comprises a housing and a light source module received in the housing, wherein the housing defines a connecting groove therein, wherein the connecting groove is in a flat strip shape and extends from an outer surface of the housing;

the luminaire further comprises a connector in a strip shape, wherein one end of the connecting groove is opened for insertion of the connector, the connecting groove is provided with a limit portion on each of two opposite side walls thereof, and a gap between each limit portion and a bottom surface of the connecting groove forms a channel guide; and the connector is provided with a connecting portion on each of two opposite sides thereof, and the connecting portion is operable to be inserted into and matched with the channel guide corresponding to the connecting portion, such that the connecting portion is limited in the channel guide corresponding to the connecting portion via the limit portion corresponding to the connecting portion; and the hinge comprises a first hinge plate, a second hinge plate, and a hinge handwheel, the first hinge plate and the second hinge plate are hinged at their edges, wherein one connector of one luminaire is disposed at the first hinge plate and one connector of another luminaire is disposed at the second hinge plate, and a length direction of each connector is parallel to a pivot between the first hinge plate and the second hinge plate;

a brake plate is fixed on the first hinge plate, wherein the brake plate is perpendicular to the pivot between the first hinge plate and the second hinge plate and defines a hinge hole in an arc-strip shape, and a portion of the second hinge plate corresponding to the hinge hole is bent and defines a hinge screw hole therein; and a hinge screw rod is arranged at a position of a central axis of the hinge handwheel, wherein the hinge screw rod penetrates the hinge hole to be in threaded connection with the hinge screw hole.

14. The luminaire combination according to claim 13, wherein the housing is in columnar shape, a central axis of the housing coincides with a light outgoing direction of the light source module, and a length direction of the connecting groove is parallel to the central axis of the housing.

15. The luminaire combination according to claim 14, wherein the housing is in a rectangular columnar shape, and defines one connecting groove on each of four side faces of the housing.

16. The luminaire combination according to claim 13, wherein the connector defines a positioning screw hole therein; and a positioning screw is operable to be in threaded connection with the positioning screw hole to allow an end portion of the positioning screw to be abutted against the bottom surface of the connecting groove, such that the connector is positioned in the connecting groove.

17. The luminaire combination according to claim 13, wherein the connector defines a connecting screw hole in a middle position along a length direction of the connector, and the connecting screw hole is located at a middle position between two connecting portions disposed on the two opposite sides of the connector.

18. The luminaire combination according to claim 17, wherein the luminaire further comprises a handwheel, the handwheel is provided with a handle screw at a position of a central axis of the handwheel, and the handle screw is operable to be in threaded connection with the connecting screw hole.

19. The luminaire combination according to claim 13, wherein the connector is further provided with a fixing portion on each of the two opposite sides of the connector, and the fixing portion and the connecting portion cooperate to define a limit groove capable of accommodating the limit portion.

20. The luminaire combination according to claim 19, wherein the two fixing portions extend away from each other and are in a flat and straight shape, and extend from one side surface, away from the connecting portion, of the connector to form a flat straight surface; or the fixing portion and the connecting portion are of the same shape and size, the fixing portion is operable to be inserted into and matched with the channel guide, such that the connector serves as a connecting pin for connecting the housing of the luminaire to a housing of another luminaire.

* * * * *